US007235113B2

(12) United States Patent
Sanfilippo et al.

(10) Patent No.: US 7,235,113 B2
(45) Date of Patent: Jun. 26, 2007

(54) USE OF AN OXYGENATED PRODUCT AS A SUBSTITUTE OF GAS OIL IN DIESEL ENGINES

(75) Inventors: Domenico Sanfilippo, Paullo (IT); Renata Patrini, Milan (IT); Mario Marchionna, Milan (IT)

(73) Assignees: ENI S.p.A., Rome (IT); Snamprogetti S.p.A., San Donato Milanese (IT)

( * ) Notice: Subject to any disclaimer, the term of this patent is extended or adjusted under 35 U.S.C. 154(b) by 376 days.

(21) Appl. No.: 10/716,501

(22) Filed: Nov. 20, 2003

(65) Prior Publication Data

US 2004/0187380 A1 Sep. 30, 2004

(30) Foreign Application Priority Data

Nov. 22, 2002 (IT) ..... MI2002A2481

(51) Int. Cl.
*C10L 1/18* (2006.01)

(52) U.S. Cl. ..... 44/444; 44/447

(58) Field of Classification Search ..... 44/444, 44/447, 448; 568/613, 618, 606; 514/723
See application file for complete search history.

(56) References Cited

U.S. PATENT DOCUMENTS

| | | | | |
|---|---|---|---|---|
| 1,582,420 | A * | 4/1926 | Nikaido | 44/444 |
| 5,746,785 | A | 5/1998 | Moulton et al. | |
| 6,166,266 | A | 12/2000 | Hagen et al. | |
| 6,514,299 | B1 * | 2/2003 | Bean et al. | 44/444 |
| 6,534,685 | B1 * | 3/2003 | Patrini et al. | 568/613 |
| 2003/0159341 | A1 * | 8/2003 | Patrini et al. | 44/444 |

FOREIGN PATENT DOCUMENTS

| | | |
|---|---|---|
| EP | 0 014 992 | 9/1980 |
| EP | 1 070 755 | 1/2001 |

* cited by examiner

*Primary Examiner*—Cephia D. Toomer
(74) *Attorney, Agent, or Firm*—Oblon, Spivak, McClelland, Maier & Neustadt, P.C.

(57) ABSTRACT

Use of a liquid oxygenated product with a cetane number higher than 50, consisting of one or more compounds selected from dialkyl-polyformals represented by the formula $$RO(CH_2O)_mR$$

wherein R is an alkyl chain $C_nH_{2n+1}$,
m is an integer equal to or higher than 2,
n is an integer between 1 and 10,
as a substitute of gas oil in diesel engines.

4 Claims, No Drawings

USE OF AN OXYGENATED PRODUCT AS A SUBSTITUTE OF GAS OIL IN DIESEL ENGINES

The present invention relates to the use of a liquid oxygenated product in a diesel engine, in particular a product consisting of one or more compounds selected from certain alkyl-polyformals which effect the reduction of diesel engine emissions.

The gases emitted by diesel engines contain toxic substances such as particulate (PM), nitrogen oxides ($NO_x$), hydrocarbons and aldehydes, and carbon monoxide (CO).

These substances are responsible for air pollution and cause various health problems.

Several solutions have been proposed for reducing the emissions of diesel engines, for example the use of catalytic converters, however there are still problems as the efficiency of these converters is not sufficient.

Another solution consists in the use of components to be added to gas oil in varying percentages (normally lower than 20%); among these compounds, oxygenated products have proved to have an important effect, mainly linked to the oxygen percentage (M. Marchionna, R. Patrini, F. Giavazzi, M. Sposini, P. Garibaldi, $16^{th}$ World Petroleum Congress, Calgary, Vol. 3, Inst. Petr. UK Publ., (2000)).

The oxygen percentage and particulate reduction correlation is particularly highlighted in the papers published by Miyamoto (SAE paper 980506 and SAE paper 2001-01-1819), Sirman (SAE 2000-01-2048), Vertin (SAE 1999-01-1508), Cheng (SAE 1999-01-3606).

It is also known that a further reduction of particulate is obtained when the oxygenated compound does not contain carbon-carbon bonds, such as methanol and dimethyl ether (DME).

Methanol has poor motor properties (cetane number 5) and it can therefore not be used as such.

DME has excellent motor properties (cetane number 76) but its use as component is not possible due to its low boiling point. The use of DME entails a substantial modification both of the engine and fuel storage system on board, as dimethyl ether is gaseous at room temperature.

The use of pure DME, or mixtures of DME with methanol (U.S. Pat. No. 6,340,003) or DME/methanol/water (WO-00/05275), is known, as the presence of DME guarantees engine functioning, but all the present problems of pure DME described above, however, also relate to these mixtures.

In SAE 2000-01-1819, Miyamoto describes the use of dimethoxy methane (DMM) at 100%, obtaining the total reduction of soot; the extreme volatility of DMM, however, again causes problems relating to storage and the handling of the product.

All these solutions are generally useful for reducing emissions but either entail substantial modifications on the motor system or create considerable problems with respect to storage and the distribution of alternative fuel.

An object of the present invention therefore relates to the formulation of an enhanced alternative diesel fuel which definitely overcomes the problems specified above, at the same time maintaining the beneficial effects of emission reduction.

It has now been found that the use of a product consisting of one or more dialkyl-polyformals, as 100% fuel in diesel engines, drastically lowers the emission of particulate, due to the high oxygen content and the absence of carbon-carbon bonds in said components, thus allowing a definite solution to the above-mentioned problems.

The use of this product does not involve substantial modifications in the fuel storage system with respect to the system currently in use.

The liquid oxygenated product, whose use as a substitute of gas oil in diesel engines is the object of this invention, consists of one or more compounds selected from dialkyl-polyformals represented by the formula $$RO(CH_2O)_mR$$

wherein R is an alkyl chain $C_nH_{2n+1}$, m is an integer equal to or higher then 2 and, preferably, lower than or equal to 6, n is an integer between 1 and 10, preferably equal to 1 or 2.

Said product has a cetane number higher than 50.

Table A below indicates the blending cetane numbers and the oxygen percentages relating to the methyl series of this group of products.

These products are extremely interesting as, in addition to having a high cetane number and oxygen content (methyl series about 42-49%, ethyl series 30-43%), which favors the almost total reduction of particulate emissions, they also derive from natural gas, an easily available and low cost raw material.

TABLE A

| Compound | b.p. (° C.) | Cetane number | Oxygen % |
|---|---|---|---|
| $CH_3O(CH_2O)_2CH_3$ | 105 | 63 | 45.2 |
| $CH_3O(CH_2O)_3CH_3$ | 156 | 78 | 47.0 |
| $CH_3O(CH_2O)_4CH_3$ | 202 | 90 | 48.1 |
| $CH_3O(CH_2O)_5CH_3$ | 242 | 100 | 48.9 |
| $CH_3O(CH_2O)_6CH_3$ | 280 | 104 | 49.5 |

The use of these mixtures almost completely abolishes the emission of particulate and hydrocarbons.

Furthermore, this drastic reduction in the emission of particulate allows the engine combustion to be optimized, also obtaining a strong reduction in nitrogen oxides.

With respect to the preparation of the dialkyl-polyformals $RO(CH_2O)_mR$, the synthesis methods are the following:

$$2\ ROH + mCH_2O \rightarrow RO(CH_2O)_mR + H_2O \quad (1)$$

$$RO(CH_2O)R + (m-1)CH_2O \rightarrow RO(CH_2O)_mR \quad (2)$$

Both reactions take place with acid catalysis.

The poly-oxy-methylene-dimethyl ethers can be prepared starting from methanol and paraformaldehyde at high temperatures (Helv. Chim. Acta 8, 64 (1925), Ann. 474, 213, (1929)); in the Dupont patent U.S. Pat. No. 2,449,469 the polyformals are prepared starting from paraformaldehyde and from the dialkyl formal, with sulfuric acid as catalyst (acid concentrations around 0.1-2% by weight).

The same applicant has claimed, through patent application IT-MI99A001614, a preparation method of said dialkyl-polyformals, which, by operating with even very low concentrations of sulfonic acids, optionally substituted with halogens, as catalysts, allows high yields to polyformals to be obtained, starting from formaldehyde and alcohols and/or dialkyl formals; said method also allows a simple and functional recovery of the catalyst from the reaction product and its recycling into the reaction medium.

The following examples are provided for a better illustration of the present invention which should in no way be considered as being limited thereto or thereby.

EXAMPLE 1

A diesel fuel having the composition indicated in Table B was tested on an engine deriving from a four-cylinder 1910 jtd FIAT equipped with a catalytic converter.

TABLE B

| Compound | weight % |
|---|---|
| $CH_3O(CH_2O)_2CH_3$ | 45 |
| $CH_3O(CH_2O)_3CH_3$ | 28 |
| $CH_3O(CH_2O)_4CH_3$ | 15 |
| $CH_3O(CH_2O)_5CH_3$ | 8 |
| $CH_3O(CH_2O)_6CH_3$ | 4 |

The engine test was carried out under static conditions, at 1,500 rpm.

The following emissions were measured: hydrocarbons, nitrogen oxides and particulate.

The following emission values were obtained, after optimization. of the recirculation ratio of the exhausted gases:

$NO_x$: 1.2 g/kwh

Particulate: 0.001 g/kwh

Hydrocarbons: 0.3 g/kwh.

These emissions are extremely reduced and remain below the strictest limits listed in the regulations for the following years, for example the Euro V limit.

EXAMPLE 2

Test number 2 was carried out using the same procedures described in Example 1, but on a mixture having the characteristics indicated in Table C.

TABLE C

| Compound | weight % |
|---|---|
| $CH_3O(CH_2O)_2CH_3$ | 0.5 |
| $CH_3O(CH_2O)_3CH_3$ | 47.5 |
| $CH_3O(CH_2O)_4CH_3$ | 30.0 |
| $CH_3O(CH_2O)_5CH_3$ | 18.0 |
| $CH_3O(CH_2O)_6CH_3$ | 4.0 |

The following emission values were obtained, after optimizing the recirculation ratio of the exhausted gases:

$NO_x$: 1.3 g/kwh

Particulate: 0.002 g/kwh

Hydrocarbons: 0.25 g/kwh.

Again, these emissions are extremely reduced and remain below the strictest limits listed in the regulations for the following years, for example the Euro V limit.

The invention claimed is:

1. A process for reducing emission of particulates in a diesel engine, comprising combusting as the only diesel fuel in the diesel engine a liquid oxygenated product, having a cetane number higher than 50, consisting of one or more compounds selected from dialkyl-polyformals represented by the formula $$RO(CH_2O)_mR$$

where R is an alkyl chain $C_nH_{2n+1}$, m is an integer equal to or higher than 2, and n is an integer between 1 and 10.

2. The process according to claim 1, wherein m is equal to or higher than 2 and lower than or equal to 6 and n is equal to 1 or 2.

3. The process according to claim 1, wherein the liquid oxygenated product consists of 45 weight % $CH_3O(CH_2O)_2CH_3$, 28 weight % $CH_3O(CH_2O)_3CH_3$, 15 weight % $CH_3O(CH_2O)_4CH_3$, 8 weight % $CH_3O\ (CH_2O)_5CH_3$, and 4 weight % $CH_3O(CH_2O)_6CH_3$.

4. The process according to claim 1, wherein the liquid oxygenated product consists of 0.5 weight % $CH_3O(CH_2O)_2CH_3$, 47.5 weight % $CH_3O(CH_2O)_3CH_3$, 30.0 weight % $CH_3O(CH_2O)_4CH_3$, 18.0 weight % $CH_3O\ (CH_2O)_5CH_3$, and 4.0 weight % $CH_3O(CH_2O)_6CH_3$.

* * * * *